US010301957B2

(12) United States Patent
Lemoine et al.

(10) Patent No.: US 10,301,957 B2
(45) Date of Patent: May 28, 2019

(54) PINNED SEAL

(71) Applicant: United Technologies Corporation, Hartford, CT (US)

(72) Inventors: Jonathan Lemoine, Vernon, CT (US); Steven J. Bauer, East Haddam, CT (US)

(73) Assignee: United Technologies Corporation, Farmington, CT (US)

( * ) Notice: Subject to any disclaimer, the term of this patent is extended or adjusted under 35 U.S.C. 154(b) by 635 days.

(21) Appl. No.: 14/969,604

(22) Filed: Dec. 15, 2015

(65) Prior Publication Data

US 2016/0177765 A1 Jun. 23, 2016

Related U.S. Application Data

(60) Provisional application No. 62/092,931, filed on Dec. 17, 2014.

(51) Int. Cl.

*F01D 11/00* (2006.01)
*F01D 25/24* (2006.01)
*F01D 25/16* (2006.01)

(52) U.S. Cl.

CPC ..... *F01D 11/005* (2013.01); *F01D 25/164* (2013.01); *F01D 25/243* (2013.01); *F05D 2240/55* (2013.01)

(58) Field of Classification Search

CPC .... F01D 11/001; F01D 11/003; F01D 11/005; F01D 25/243; F01D 25/162; F16J 15/061; F16J 15/0831

See application file for complete search history.

(56) References Cited

U.S. PATENT DOCUMENTS

| | | | | |
|---|---|---|---|---|
| 4,330,134 | A | 5/1982 | Kolinger | |
| 5,249,920 | A * | 10/1993 | Shepherd | F01D 11/005 415/134 |
| 6,364,606 | B1 | 4/2002 | Rice et al. | |
| 7,040,098 | B2 * | 5/2006 | Lepretre | F01D 11/005 415/214.1 |
| 7,819,622 | B2 * | 10/2010 | Paulino | F01D 9/041 415/104 |
| 7,854,586 | B2 | 12/2010 | Major et al. | |
| 8,382,121 | B2 | 2/2013 | Suefuji | |
| 8,579,655 | B2 | 11/2013 | Kawamura | |

(Continued)

FOREIGN PATENT DOCUMENTS

| | | | | |
|---|---|---|---|---|
| WO | WO 2014138078 A1 * | 9/2014 | | F01D 11/005 |
| WO | WO 2014150353 A1 * | 9/2014 | | F01D 11/003 |

*Primary Examiner* — Justin D Seabe
(74) *Attorney, Agent, or Firm* — Kinney & Lange, P.A.

(57) ABSTRACT

An assembly includes a case structure, a seal interfacing with the case structure, a first pin, and a main pin hole on one of the seal and the case structure. The first pin extends through the main pin hole and is fixed relative to the other of the seal and the case structure. The assembly also includes a second pin and a secondary pin hole on one of the seal and the case structure. The second pin extends through the secondary pin hole. A cross-sectional gap area between the second pin and the secondary pin hole is greater than a cross-sectional gap area between the first pin and the main pin hole. Also included is a bolt hole on one of the seal and the case structure. The bolt hole is circumferentially located between the main pin hole and the secondary pin hole.

19 Claims, 5 Drawing Sheets

(56) References Cited

U.S. PATENT DOCUMENTS

| | | | | |
|---|---|---|---|---|
| 2006/0292001 | A1 | 12/2006 | Keller et al. | |
| 2011/0081234 | A1* | 4/2011 | Durocher | F01D 25/243 415/134 |
| 2013/0200571 | A1* | 8/2013 | Mutou | F01D 5/081 277/412 |
| 2013/0309078 | A1* | 11/2013 | Vo | F01D 9/04 415/208.1 |

* cited by examiner

PINNED SEAL

CROSS-REFERENCE TO RELATED APPLICATION(S)

This application claims the benefit of U.S. Provisional Application No. 62/092,931 filed Dec. 17, 2014 for "Pinned Seal" by Jonathan Lemoine and Steven J. Bauer.

BACKGROUND

The present embodiments relate generally to seals, and more particularly to seals for use within gas turbine engines.

The use of seals within gas turbine engines improves efficiency. Seals serve to prevent unintended leaks of various fluids, such as hot combustion gasses, cooling air, and lubricant, used in the operation of the gas turbine engine. By preventing such fluids from entering unintended cavities and other locations, the gas turbine engine is able to make more work out of the fluid. However, in order for seals to prevent unintended leakage and improve efficiency, the seals must be configured in appropriate locations within the gas turbine engine.

Often, seals are required to be positioned within the gas turbine engine at locations which can be difficult to access, necessitating at times a blind assembly. Consequently, assembly of the seal in its appropriate location can be complicated and time consuming. For example, some current seals are designed to be snap-fit to an interfacing structure to both center the seal and create a substantially air-tight interface. However, assembling the snap-fit seal in position can be a blind assembly further complicated by a tightly toleranced snap-fit between the seal and the interfacing structure required to create the air-tight interface. One solution to simplify this blind assembly is to apply heat to the interfacing structure to cause the interfacing structure to expand and thus ease the snap-fit. Nevertheless, this increases the time needed to assemble the seal in position, and especially when compounded with numerous other seal assemblies within the same engine, further acts to increase the complexity and costs associated with assembling the seals.

SUMMARY

One embodiment includes as assembly for sealing at least one cavity in a gas turbine engine. The assembly includes a case structure, a seal interfacing with the case structure, a first pin, and a main pin hole on one of the seal and the case structure. The first pin extends through the main pin hole and is fixed relative to the other of the seal and the case structure. The assembly also includes a second pin and a secondary pin hole on one of the seal and the case structure. The second pin extends through the secondary pin hole. A cross-sectional gap area between the second pin and the secondary pin hole is greater than a cross-sectional gap area between the first pin and the main pin hole. Also included is a bolt hole on one of the seal and the case structure. The bolt hole is circumferentially located between the main pin hole and the secondary pin hole.

Another embodiment includes a method of assembling a seal. A first pin is inserted through a main pin hole on one of the seal and a case structure. A second pin is inserted through a secondary pin hole on one of the seal and the case structure. The first pin and the second pin are configured such that a cross-sectional gap area between the second pin and the secondary pin hole is greater than a cross-sectional gap area between the first pin and the main pin hole.

A further embodiment includes an assembly having a seal that includes a planar face, an outer portion extending generally radially from the planar face in a first direction at an angle, and an inner portion extending generally radially from the planar face in a second direction, opposite the first direction, at an angle. Also included is a case structure having a planar face extending generally radially outward from the case structure. The case structure planar face interfaces with the seal planar face. Additionally, a main pin hole is included on both the seal planar face and the case structure planar face. The main pin hole on the seal planar face and the main pin hole on the case structure planar face are aligned. A first pin extends through the main pin hole on both the planar face of the seal and the planar face of the case structure. Also, a secondary pin hole is included on both the seal planar face and the case structure planar face. The secondary pin hole on the seal planar face and the secondary pin hole on the case structure planar face are aligned. A second pin extends through the secondary pin hole on both the planar face of the seal and the planar face of the case structure. A cross-sectional gap area between the second pin and the secondary pin hole is greater than a cross-sectional gap area between the first pin and the main pin hole.

Figure 1:
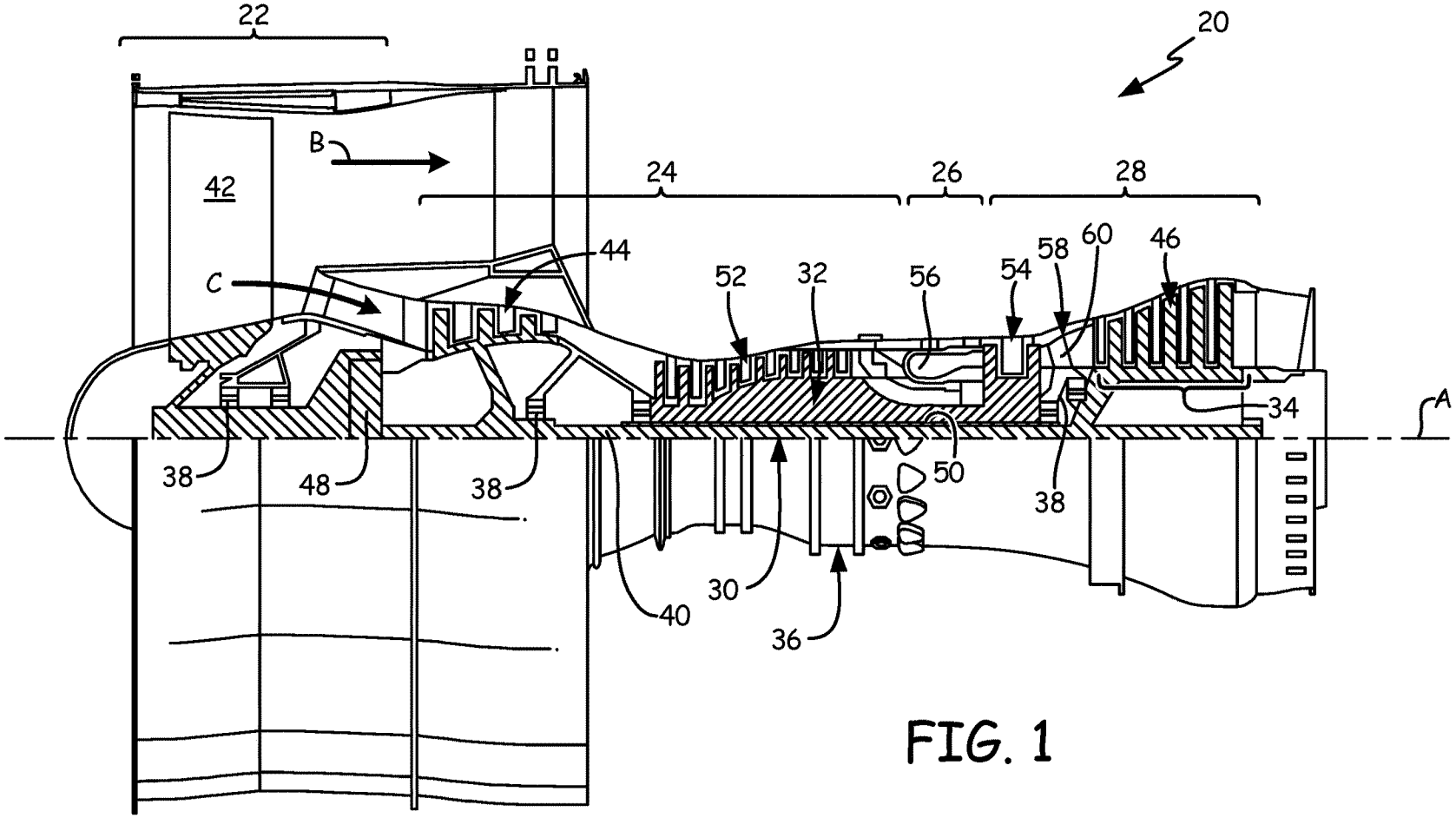
FIG. 1 is a schematic quarter sectional view of an embodiment of a gas turbine engine.

While the above-identified drawing figures set forth multiple embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The present embodiments provide assemblies and methods for reducing the complexity of a seal assembly, without altering the functionality of the seal assembly, through use of an arrangement of pins.

FIG. 1 is a quarter sectional view that schematically illustrates an example gas turbine engine 20 that includes fan section 22, compressor section 24, combustor section 26 and turbine section 28. Alternative engines might include an augmenter section (not shown) among other systems or features. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use within turbofans as the teachings may be applied to other types of turbine engines; for example, an industrial gas turbine; a reverse-flow gas turbine engine; and a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

Example engine 20 generally includes low speed spool 30 and high speed spool 32 mounted for rotation about engine central longitudinal axis A relative to engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide double stage high pressure turbine 54. In another example, high pressure turbine 54 includes only a single stage. As used herein, a "high pressure" compressor or turbine experiences a higher pressure than a corresponding "low pressure" compressor or turbine.

Example low pressure turbine 46 includes turbine rotors schematically indicated at 34 and has a pressure ratio that is greater than about 5. The pressure ratio of example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 can be arranged generally between high pressure turbine 54 and low pressure turbine 46. Mid-turbine frame 58 can include vanes 60 and further supports bearing systems 38 in turbine section 28 as well as setting airflow entering low pressure turbine 46.

Core airflow C is compressed by low pressure compressor 44 then by high pressure compressor 52 and mixed with fuel and ignited in combustor 56 to produce high speed exhaust gases that are then expanded through high pressure turbine 54 and low pressure turbine 46.

The disclosed gas turbine engine 20 in one example is a high-bypass geared aircraft engine. In a further example, gas turbine engine 20 includes a bypass ratio greater than about six (6), with an example embodiment being greater than about ten (10). Example geared architecture 48 is an epicyclical gear train, such as a planetary gear system, star gear system or other known gear system, with a gear reduction ratio of greater than about 2.3.

In one disclosed embodiment, gas turbine engine 20 includes a bypass ratio greater than about ten (10:1) and the fan diameter is significantly larger than an outer diameter of low pressure compressor 44. It should be understood, however, that the above parameters are only exemplary of one embodiment of a gas turbine engine including a geared architecture and that the present disclosure is applicable to other gas turbine engines with or without geared architecture.

A significant amount of thrust is provided by bypass flow B due to the high bypass ratio. Fan section 22 of engine 20 is designed for a particular flight condition—typically cruise at about 0.8 Mach and about 35,000 feet (10,668 m). The flight condition of 0.8 Mach and 35,000 ft. (10,668 m), with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

Figure 2:
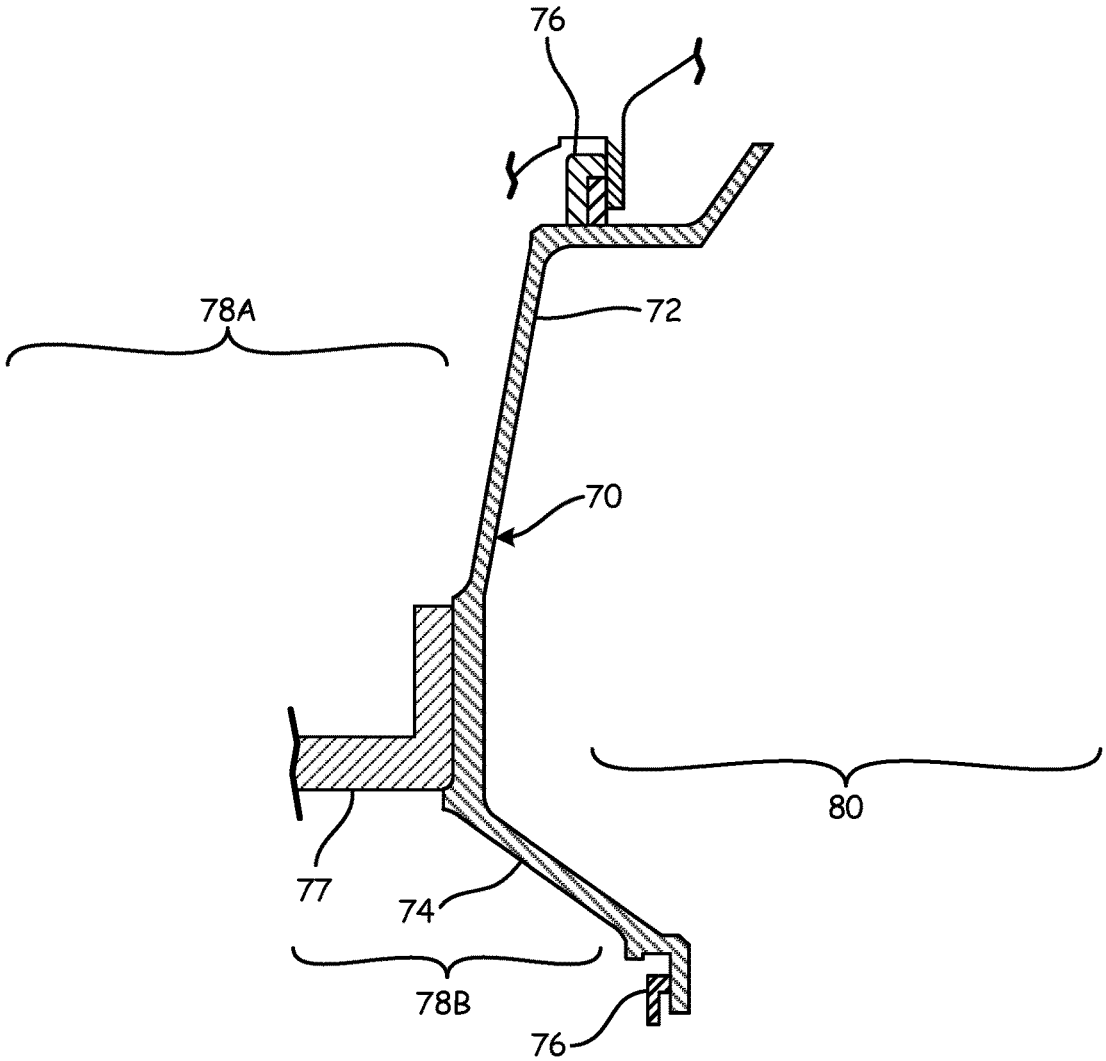
FIG. 2 is a cross-sectional view of an embodiment of a seal assembly of the present invention.

FIG. 2 shows a cross-sectional view of an embodiment of seal 70. Seal 70 has outer end 72 and inner end 74. In the illustrated embodiment, seal 70 holds piston seals 76 at both outer end 72 and inner end 74. Seal 70 can be coupled to an interfacing case or support structure 77 such that seal 70 functions as a type of cover plate to prevent fluid communication between cavity 78A and cavity 80, as well as between cavity 78B and cavity 80. Seal 70 can be coupled to case or support structure 77 such that seal 70 is tightly toleranced (i.e. in a radial direction) in manner that allows piston seals 76 to function to prevent fluid leakage from cavity 78A to cavity 80 at outer end 72 as well from cavity 78B to cavity 80 at inner end 74.

In one application, structure 77 can be a case structure of mid-turbine frame 58, such as an inner case of mid-turbine frame 58. In such an application, cavity 78A can be a mid-turbine frame cavity, cavity 78B can be a bearing cavity, and cavity 80 can be a low pressure turbine rotor cavity. Where case structure 77 is an inner case of mid-turbine frame 58, seal 70 is positioned in place as shown as a blind assembly. Consequently, it is beneficial to provide a seal 70 configuration which allows for ease of assembly.

Figure 3A:
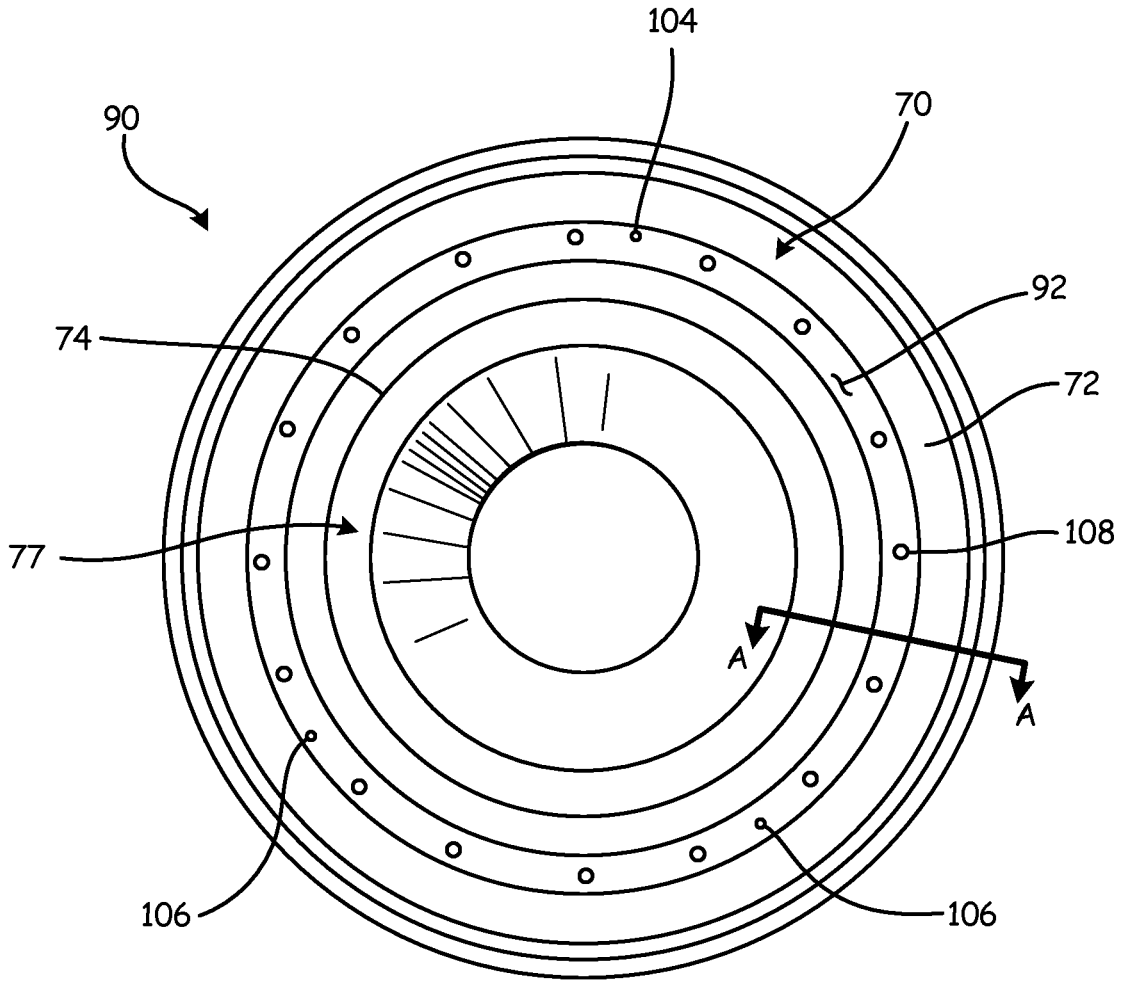
FIG. 3A is an elevational view aft looking forward of an embodiment of the seal assembly of the present invention.
Figure 3B:
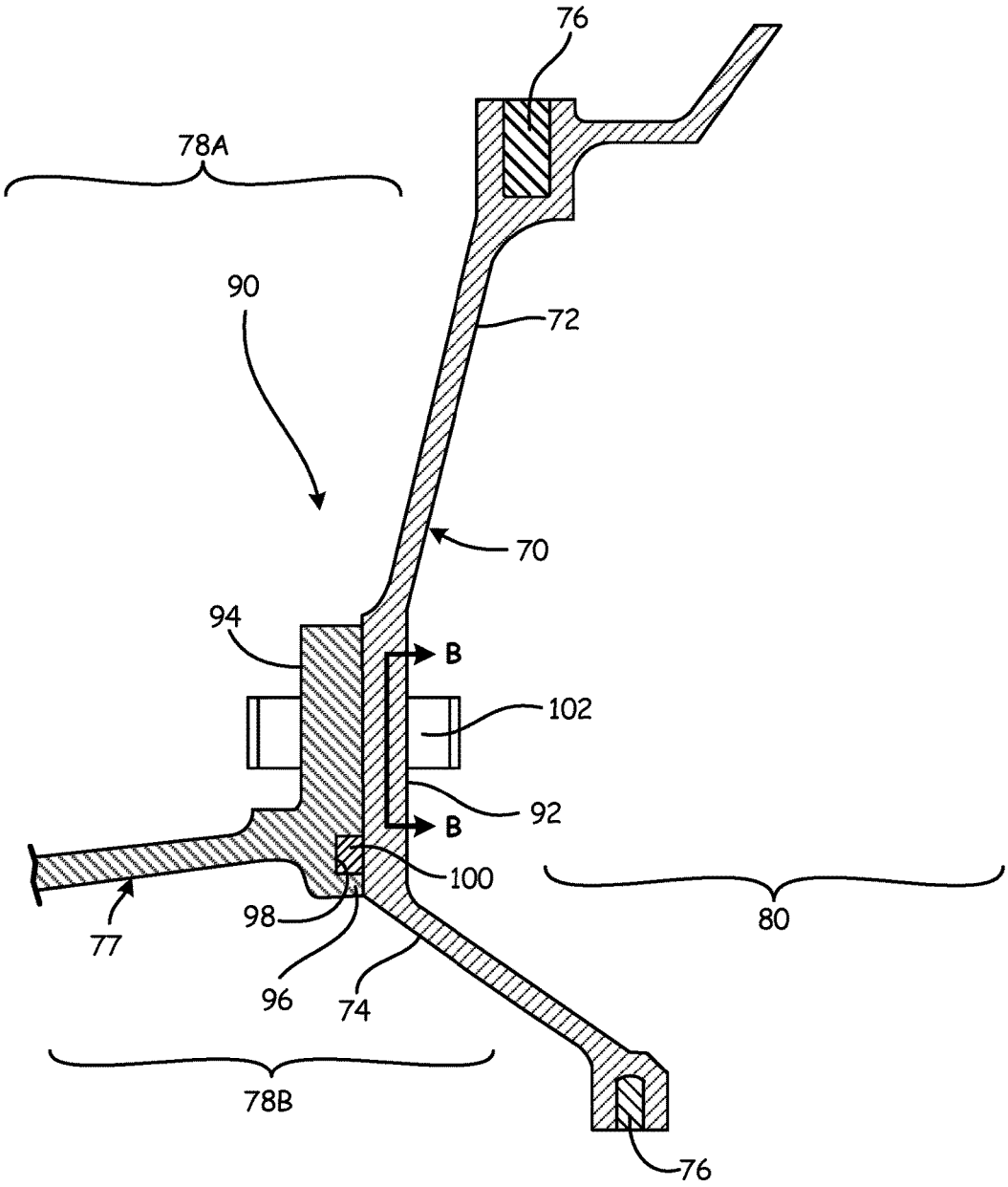
FIG. 3B is a cross-sectional view of a seal and case interface taken along line A-A of FIG. 3A.

FIGS. 3A and 3B show an embodiment of seal assembly 90, shown in isolation for simplicity. FIG. 3A is an elevational view aft looking forward of seal assembly 90, while FIG. 3B is a cross-sectional view of seal assembly 90 taken along line A-A of FIG. 3A.

Seal 70 interfaces with case structure 77. Seal 70 includes planar face 92, outer portion 72 which extends generally radially outward from planar face 92 at an angle, and inner portion 74 which extends generally radially inward, in a direction opposite that of outer portion 72, from planar face 92 at an angle. Case structure 77 includes planar face 94 which extends generally radially outward on an end of case structure 77 such that planar face 94 interfaces with planar face 92. Planar face 94 includes flange 96 defining groove 98. In the illustrated embodiment, flange 96, and thus groove 98, interfaces with planar face 92 of seal 70. In one embodiment, a secondary seal 100 can be positioned at least partially within groove 98 to further seal the interface of planar faces 92 and 94 when desired.

Seal 70 is coupled to case structure 77 through use of pins 102. At least one main pin hole 104 is located on at least one of seal 70 and case structure 77, and at least one secondary pin hole 106 is located on at least one of seal 70 and case structure 77. In embodiments where pins 102 are integral to one of seal 70 and case structure 77, main pin hole 104 and secondary pin hole 106 are only present in the other of seal 70 and case structure 77. In embodiments where pins 102 are individual components separate from both seal 70 and case structure 77, main pin hole 104 and secondary pin hole 106 are present on both seal 70 and case structure 77 and generally aligned. The illustrated embodiment uses one main pin hole 104 and two secondary pin holes 106, however in other embodiments any number of main pin holes 104 and secondary pin holes 106 can be used as long as there is at least one each of holes 104 and 106. Additionally, in the illustrated embodiment main pin hole 104 and secondary pin holes 106 are located on at least one of planar face 92 or planar face 94. However, in other embodiments holes 104 and 106 can be located on other areas of seal 70 and cases structure 77. Assembly 90 can further include bolt hole 108 on one of seal 70 and case structure 77. Bolt hole 108 can be circumferentially located between main pin hole 104 and secondary pin hole 106.

To couple seal 70 to case structure 77, pins 102 are inserted through main pin hole 104 and secondary pin hole 106. Pins 102 should be appropriately sized for the intended application such that pins 102 can withstand expected shear and running loads. In some embodiments, pins 102 can first be press-fit into one of the seal 70 and case structure 77, or pins 102 can be integral to one of seal 70 and case structure 77. Where pins 102 are separate components from seal 70 and case structure 77, main pin holes 104 on both seal 70 and case structure 77 are aligned and secondary pin holes 106 on both seal 70 and case structure 77 are aligned. Pins 102 are then inserted to extend through main pin hole 104 and secondary pin hole 106. Secondary seal 100 can also be configured within groove 98 if desired in a particular application. Secondary seal 100 can be, for example, a W-seal or C-seal glued within at least a portion of 98. Once pins 102 are engaged within both main pin hole 104 and secondary pin hole 106, bolt hole 108 can have bolts or other securing means inserted within and torqued or otherwise further secured within bolt hole 108.

Bolt hole 108 can also serve a mistake-proofing function. For example, a number of bolt holes 108 on one of seal 70 and case structure 77 circumferentially located between one secondary pin hole 106 and another secondary pin hole 106 can be different than a number of bolt holes 108 on one of the seal 70 and case structure 77 circumferentially located between main pin hole 104 and each of the secondary pin holes 106. In the illustrated embodiment, there are four bolt holes 108 located between secondary pin holes 106, and six bolt holes 108 located between each secondary pin hole 106 and main pin hole 104. This serves to allow main pin hole or holes 104 to be distinguished from secondary pin hole or holes 106. In other embodiments, other arrangements of a number of bolt holes can be varied in any manner that allows main pin hole or holes 104 to be distinguished from secondary pin hole or holes 106. Although described as bolt holes 108, these could be holes intended for other fasteners in further embodiments.

Figure 4A:
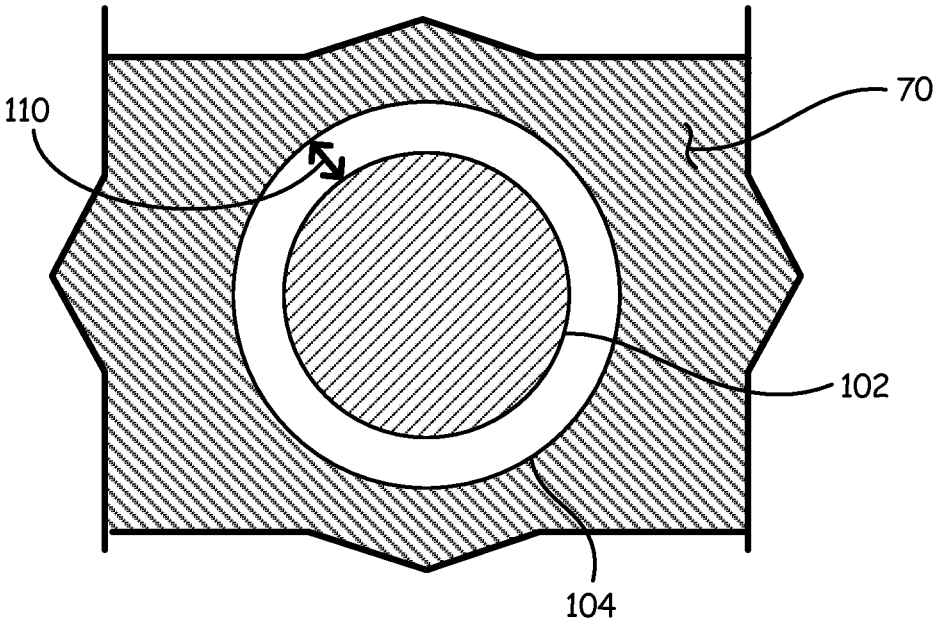
FIG. 4A is a schematic, cross-sectional view of a pin and a main pin hole taken along line B-B of FIG. 3B.
Figure 4B:
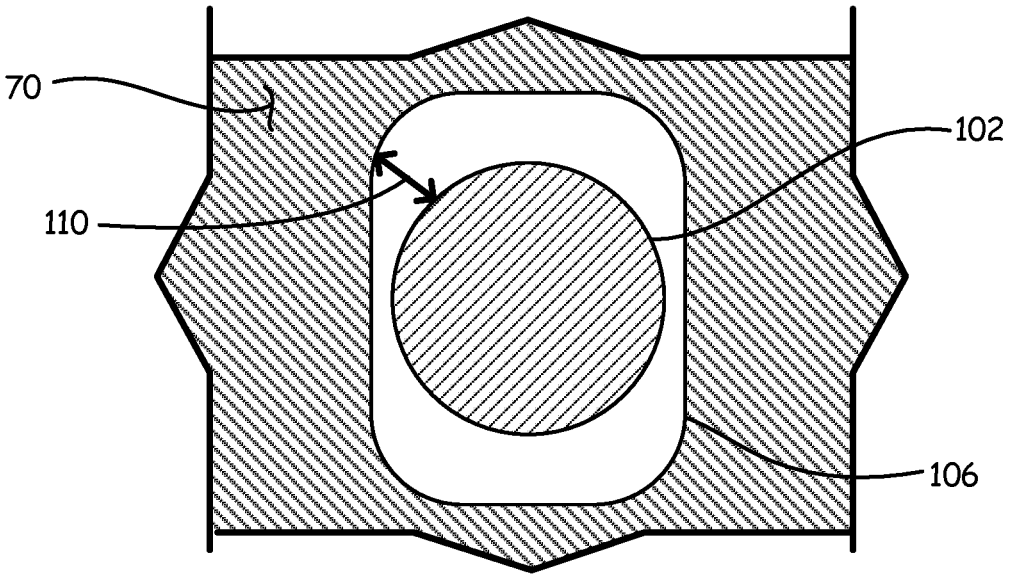
FIG. 4B is a schematic, cross-sectional view of a pin and a secondary pin hole taken along line B-B of FIG. 3B.

It is important to be able to distinguish between main pin hole 104 and secondary pin hole 106 because holes 104 and 106 can differ. FIG. 4A shows a schematic, cross-sectional view, taken along line B-B of FIG. 3B, of main pin hole 104, while FIG. 4B shows a schematic, cross-sectional view, also taken along line B-B of FIG. 3B, of secondary pin hole 106. Pin holes 104 and 106 are shown on seal 70. In a further embodiment, pin holes 104 and 106 can be located on seal 70 at planar face 92 with planar face 94 of case structure 77 aligned such that pins 102 couple seal 70 to case structure 77 at the interfacing planar faces 92 and 94. Main pin hole 104 is more tightly toleranced than secondary pin hole 106. In other words, cross-sectional gap area 110, defined between a perimeter of pin 102 and a perimeter of hole 104 or 106, is less for main pin hole 104 than for secondary pin hole 106.

Configuring cross-sectional gap area 110 for secondary pin hole 106 to be greater than cross-sectional gap area 110 for main pin hole 104 can be accomplished in any number of ways. For example, a same pin 102 can be used to extend through both main pin hole 104 and secondary pin hole 106, but secondary pin hole 106 can be made to have a greater cross-sectional area than main pin hole 104. As illustrated in FIGS. 4A and 4B, main pin hole 104 has a cross-sectional shape that is the same as a cross-sectional shape of pin 102 (e.g., circular), while secondary pin hole 106 has a cross-sectional shape that is different than a cross-sectional shape of pin 102—secondary pin hole 106 has an ovalized (or elliptical) cross-sectional shape in a radial direction, while pin 102 has a circular cross-sectional shape. In other embodiments, the ovalized cross-sectional shape of secondary pin hole 106 can be oriented (i.e. rotated circumferentially with respect to the illustrated orientation) in any number of ways. Various other cross-sectional shapes can be utilized to create a larger cross-sectional gap area 110 between hole 106 and pin 102 as compared to a cross-sectional gap area 110 between hole 104 and pin 102. In other embodiments, holes 104 and 106 can have substantially similar cross-sectional areas while pin 102 having a relatively smaller cross-sectional area is inserted through hole 104 and pin 102 having a relatively larger cross-sectional area is inserted through hole 106. Those skilled in the art will realize that numerous other configurations of pin 102 within holes 104 and 106 can be utilized such that the fit between hole 106 and pin 102 is oversized in comparison to the fit between hole 104 and pin 102.

By configuring the fit between hole 106 and pin 102 to be oversized in comparison to the fit between hole 104 and pin 102, holes 104 and 106 serve different functions for assembly 90. Main pin hole 104 serves as a locating feature, and as such centers and locates seal 70 close enough to case structure 77 in a particular application to create a sealed interface between seal 70 and case structure 77. On the other hand, secondary pin hole 106 serves to prevent movement of one of seal 70 or case structure 77 relative to the other of seal 70 and case structure 77.

Assembly 90 provides a simplistic means for configuring seal 70 in an area which can be difficult to access, while at the same time maintaining the functionality of seal 70. For instance, assembly 90 does away with the complexity of previous seal assemblies utilizing a snap-fit while still tightly tolerancing seal 70 to case structure 77 and allowing piston seals 76 to be tightly configured at their intended positions such that substantially all fluid leakage is still prevented. Furthermore, assembly 90 can be completed as a blind assembly, without any need to heat interfacing components, and can be done while engine 20 is vertical or horizontal. A blind assembly, for example, can occur where assembly 90 is to be configured at a location that is difficult to access and does not afford a direct line of sight of at least some of the components being assembled, or for which access is possible from one side only.

Discussion of Possible Embodiments

The following are non-exclusive descriptions of possible embodiments of the present invention.

An assembly for sealing at least one cavity in a gas turbine engine, the assembly comprising: a case structure; a seal interfacing with the case structure; a first pin; a main pin hole on one of the seal and the case structure, wherein the first pin extends through the main pin hole and is fixed relative to the other of the seal and the case structure; a second pin; a secondary pin hole on one of the seal and the case structure, wherein the second pin extends through the secondary pin hole, and wherein a cross-sectional gap area between the second pin and the secondary pin hole is greater than a cross-sectional gap area between the first pin and the main pin hole; and a bolt hole on one of the seal and the case structure, wherein the bolt hole on one of the seal the case structure is circumferentially located between the main pin hole and the secondary pin hole.

The assembly of the preceding paragraph can optionally include, additionally and/or alternatively, the following features, configurations and/or additional components:

The main pin hole on one of the seal and the case structure has a cross-sectional shape that is the same as a cross-sectional shape of the first pin.

The secondary pin hole on one of the seal and the case structure has a cross-sectional shape that differs from a cross-sectional shape of the second pin.

The secondary pin hole on one of the seal and the case structure has a cross-sectional shape that is ovalized in a radial direction, and wherein the cross-sectional shape of the second pin is circular.

The case structure includes a flange defining a groove at a location on the case structure which interfaces with the seal.

A secondary seal is located within the groove.

A first piston seal held by the seal on an outer end; and a second piston seal held by the seal on an inner end.

Another second pin; and another secondary pin hole on one of the seal and the case structure, wherein the another second pin extends through the another secondary pin hole on one of the seal and the case structure, and wherein a cross-sectional area between the another second pin and the another secondary pin hole is greater than a cross-sectional area between the first pin and the main pin hole.

A number (n1) of bolt holes on one of the seal and the case structure circumferentially located between one of the secondary pin holes and the other of the secondary pin holes is different than a number (n2) of bolt holes on one of the seal and the case structure circumferentially located between the main pin hole and one of the secondary pin holes and between the main pin hole and the other of the secondary pin holes.

The case structure is an inner case and the seal is located between a mid-turbine frame cavity and a low pressure turbine rotor cavity.

A method of assembling a seal, the method comprising: inserting a first pin through a main pin hole on one of the seal and a case structure; inserting a second pin through a secondary pin hole on one of the seal and the case structure; and configuring the first pin within the main pin hole and the second pin within the secondary pin hole such that a cross-sectional gap area between the second pin and the secondary pin hole is greater than a cross-sectional gap area between the first pin and the main pin hole.

The method of the preceding paragraph can optionally include, additionally and/or alternatively, the following techniques, steps, features and/or configurations:

Inserting another second pin through another secondary pin hole on one of the seal and the case structure; and configuring the another second pin within the another secondary pin hole such that a cross-sectional gap area between the another second pin and the another secondary pin hole is greater than a cross-sectional gap area between the first pin and the main pin hole.

Configuring a number of aligned bolt holes circumferentially between the second pins to differ from a number of aligned bolt holes circumferentially between both the first pin and one of the second pins and the first pin and the another of the second pins.

Inserting a secondary seal within a groove defined by a flange of the case structure at a location on the case structure which interfaces with the seal.

Inserting the first pin and inserting the second pin comprises press-fitting the first pin and press-fitting the second pin into the case structure.

Inserting the first pin, inserting the second pin, and configuring the first and second pins is performed as a blind assembly.

An assembly comprising: a seal comprising, a planar face; an outer portion extending generally radially from the planar face in a first direction at an angle; and an inner portion extending generally radially from the planar face in a second direction at an angle, wherein the first direction is generally opposite the second direction; a case structure including a planar face extending generally radially outward from the case structure, wherein the planar face of the case structure interfaces with the planar face of the seal; a first pin; a main pin hole on both the planar face of the seal and the planar face of the case structure, wherein the main pin hole on the planar face of the seal and the main pin hole on the planar face of the case structure are aligned, and wherein the first pin extends through the main pin hole on both the planar face of the seal and the planar face of the case structure; a second pin; and a secondary pin hole on both the planar face of the seal and the planar face of the case structure, wherein the secondary pin hole on the planar face of the seal and the secondary pin hole on the planar face of the case structure are aligned, and wherein the second pin extends through the secondary pin hole on both the planar face of the seal and the planar face of the case structure, and wherein a cross-sectional gap area between the second pin and the secondary pin hole is greater than a cross-sectional gap area between the first pin and the main pin hole.

The assembly of the preceding paragraph can optionally include, additionally and/or alternatively, the following features, configurations and/or additional components:

A bolt hole on both the planar face of the seal and the planar face of the case structure, wherein the bolt hole on the planar face of the seal and the bolt hole on the planar face of the case structure are aligned, and wherein the bolt hole on the planar face of the seal and the bolt hole on the planar face of the case structure are circumferentially located between the main pin hole and the secondary pin hole.

Another second pin extending through another secondary pin hole on both the planar face of the seal and the planar face of the case structure, wherein a number (n1) of aligned bolt holes on both the planar face of the seal and the planar face of the case structure circumferentially located between one of the second pins and the another of the second pins differs from a number (n2) of aligned bolt holes on both the planar face of the seal and the planar face of the case structure circumferentially located between the first pin and the one second pin and between the first pin and the another second pin.

The planar face of the case structure includes a flange defining a groove in the planar face of the case structure, and wherein a secondary seal is located at least partially within the groove.

Any relative terms or terms of degree used herein, such as "generally", "substantially", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly for sealing at least one cavity in a gas turbine engine, the assembly comprising: a case structure; a seal interfacing with the case structure; a plurality of bolt holes configured to receive bolts or other securing elements, wherein the bolt holes are circumferentially spaced on one of the seal and the case structure; a main pin hole located circumferentially between a pair of bolt holes on one of the seal and the case structure; a first pin extending through the main pin hole, wherein the first pin is fixed relative to the other of the seal and the case structure; a secondary pin hole located circumferentially between an another pair of bolt holes on one of the seal and the case structure; and a second pin extending through the secondary pin hole, wherein the second pin is fixed relative to the other of the seal and the case structure, and wherein a cross-sectional gap area between the second pin and the secondary pin hole is greater than a cross-sectional gap area between the first pin and the main pin hole, wherein the plurality of bolt holes, the main pin hole, and the secondary pin hole are each positioned along a common circumference.

2. The assembly of claim 1, wherein the main pin hole on one of the seal and the case structure has a cross-sectional shape that is the same as a cross-sectional shape of the first pin.

3. The assembly of claim 1, wherein the secondary pin hole on one of the seal and the case structure has a cross-sectional shape that differs from a cross-sectional shape of the second pin.

4. The assembly of claim 3, wherein the secondary pin hole on one of the seal and the case structure has a cross-sectional shape that is ovalized in a radial direction, and wherein the cross-sectional shape of the second pin is circular.

5. The assembly of claim 1, wherein the case structure includes a flange defining a groove at a location on the case structure which interfaces with the seal.

6. The assembly of claim 5, wherein a secondary seal is located within the groove.

7. The assembly of claim 1, further comprising:

a first piston seal held by the seal on an outer end; and a second piston seal held by the seal on an inner end.

8. The assembly of claim 1, and further comprising:

another second pin; and another secondary pin hole on one of the seal and the case structure, wherein the another second pin extends through the another secondary pin hole on one of the seal and the case structure, and wherein a cross-sectional area between the another second pin and the another secondary pin hole is greater than a cross-sectional area between the first pin and the main pin hole.

9. The assembly of claim 8, wherein a number (n1) of bolt holes on one of the seal and the case structure circumferentially located between one of the secondary pin holes and the other of the secondary pin holes is different than a number (n2) of bolt holes on one of the seal and the case structure circumferentially located between the main pin hole and one of the secondary pin holes and between the main pin hole and the other of the secondary pin holes.

10. The assembly of claim 1, wherein the case structure is an inner case and the seal is located between a mid-turbine frame cavity and a low pressure turbine rotor cavity.

11. A method of assembling a seal, the method comprising: inserting a first pin through a main pin hole on one of the seal and a case structure, wherein the first pin is fixed relative to the other of the seal and the case structure; inserting a second pin through a secondary pin hole on one of the seal and the case structure, wherein the second pin is fixed relative to the other of the seal and the case structure; and configuring the first pin within the main pin hole and the second pin within the secondary pin hole such that a cross-sectional gap area between the second pin and the secondary pin hole is greater than a cross-sectional gap area between the first pin and the main pin hole; wherein a plurality of bolt holes configured to receive bolts or other securing elements are circumferentially spaced on one of the seal and the case structure; and wherein each of the main pin hole and the secondary pin hole is located circumferentially between a pair of bolt holes on one of the seal and the case structure, wherein the plurality of bolt holes, the main pin hole, and the secondary pin hole are each positioned along a common circumference.

12. The method of claim 11, further comprising:

inserting another second pin through another secondary pin hole on one of the seal and the case structure; and configuring the another second pin within the another secondary pin hole such that a cross-sectional gap area between the another second pin and the another secondary pin hole is greater than a cross-sectional gap area between the first pin and the main pin hole.

13. The method of claim 12, further comprising:

configuring a number of aligned bolt holes circumferentially between the second pins to differ from a number of aligned bolt holes circumferentially between both the first pin and one of the second pins and the first pin and the another of the second pins.

14. The method of claim 11, further comprising:

inserting a secondary seal within a groove defined by a flange of the case structure at a location on the case structure which interfaces with the seal.

15. The method of claim 11, wherein inserting the first pin and inserting the second pin comprises press-fitting the first pin and press-fitting the second pin into the case structure.

16. The method of claim 11, wherein inserting the first pin, inserting the second pin, and configuring the first and second pins is performed as a blind assembly.

17. An assembly comprising: a seal comprising, a planar face; an outer portion extending generally radially from the planar face in a first direction at an angle; and an inner portion extending generally radially from the planar face in a second direction at an angle, wherein the first direction is generally opposite the second direction; a case structure including a planar face extending generally radially outward from the case structure, wherein the planar face of the case structure interfaces with the planar face of the seal; a plurality of bolt holes configured to receive bolts or other securing elements, wherein the bolt holes are circumferentially spaced on both the planar face of the seal and the planar face of the case structure, and wherein the bolt holes on the planar face of the seal and the bolt holes on the planar face of the case structure are aligned; a first pin, wherein the first pin is fixed relative to the other of the seal and the case structure; a main pin hole on both the planar face of the seal and the planar face of the case structure located circumferentially between a pair of bolt holes on both the planar face of the seal and the planar face of the case structure, wherein the main pin hole on the planar face of the seal and the main pin hole on the planar face of the case structure are aligned, and wherein the first pin extends through the main pin hole on both the planar face of the seal and the planar face of the case structure; a second pin, wherein the second pin is fixed relative to the other of the seal and the case structure; and a secondary pin hole on both the planar face of the seal and the planar face of the case structure located circumferentially between an another pair of bolt holes on both the planar face of the seal and the planar face of the case structure, wherein the secondary pin hole on the planar face of the seal and the secondary pin hole on the planar face of the case structure are aligned, and wherein the second pin extends through the secondary pin hole on both the planar face of the seal and the planar face of the case structure, and wherein a cross-sectional gap area between the second pin and the secondary pin hole is greater than a cross-sectional gap area between the first pin and the main pin hole, wherein the plurality of bolt holes, the main pin hole, and the secondary pin hole are each positioned along a common circumference.

18. The assembly of claim 17, further comprising:

another second pin extending through another secondary pin hole on both the planar face of the seal and the planar face of the case structure, wherein a number (n1) of aligned bolt holes on both the planar face of the seal and the planar face of the case structure circumferentially located between one of the second pins and the another of the second pins differs from a number (n2) of aligned bolt holes on both the planar face of the seal and the planar face of the case structure circumferentially located between the first pin and the one second pin and between the first pin and the another second pin.

19. The assembly of claim 17, wherein the planar face of the case structure includes a flange defining a groove in the planar face of the case structure, and wherein a secondary seal is located at least partially within the groove.

* * * * *